United States Patent [19]

Ellison

[11] 4,258,497

[45] Mar. 31, 1981

[54] EDUCATIONAL BUILDING BLOCKS

[76] Inventor: Donald R. Ellison, 4371 - 25th St., San Francisco, Calif. 94114

[21] Appl. No.: 763,916

[22] Filed: Jan. 31, 1977

Related U.S. Application Data

[63] Continuation-in-part of Ser. No. 637,330, Dec. 3, 1975, abandoned.

[51] Int. Cl.[3] ..... A63N 33/08

[52] U.S. Cl. ..... 46/25

[58] Field of Search ..... 35/18 A, 72; 46/23, 46/24, 25; 272/111

[56] References Cited

U.S. PATENT DOCUMENTS

| | | | |
|---|---|---|---|
| 1,894,605 | 1/1933 | Wright | 46/25 |
| 2,278,327 | 3/1942 | Magnus | 46/25 |
| 2,319,914 | 5/1943 | Blanding | 46/25 |
| 2,690,032 | 9/1954 | Zalkind | 46/25 X |
| 3,389,493 | 6/1968 | Zysset | 46/25 |
| 3,589,716 | 6/1971 | Footlik | 272/111 |
| 3,600,825 | 8/1971 | Pearce | 35/18 A |

FOREIGN PATENT DOCUMENTS

| | | | |
|---|---|---|---|
| 309945 | 12/1955 | Switzerland | 46/25 |
| 385086 | 2/1965 | Switzerland | 46/25 |

*Primary Examiner*—Harland S. Skogquist

*Attorney, Agent, or Firm*—Limbach, Limbach & Sutton

[57] ABSTRACT

Educational building blocks are described which comprise a right prism member and two flat rectangular plates having widths equal to the altitude of the prism and lengths greater than the greatest altitude of the prism bases. One of the plates is attached to each base of the prism so that the flat surface of the plates coincide with the prism bases. The flat plates are so oriented that they are in mirror image relationship to each other. Blocks of this kind may be fitted together to create a great variety of structures and forms.

7 Claims, 4 Drawing Figures

EDUCATIONAL BUILDING BLOCKS

This application is a continuation-in-part of application Ser. No. 637,330 filed Dec. 3, 1975, and now abandoned.

BACKGROUND OF THE INVENTION

Numerous writers in the field of education have noted the value of block play in the development of perceptual, motor and conceptual capabilities of children. Various buidling blocks have been described in the prior art which are used to amuse children, to provide them with a means to experiment with structures and forms and to provide them with an opportunity to excercise imagination and originality in creating new structural patterns such as shown in U.S. Pat. Nos. 3,787,996 3,303,604, 3,708,910, 2,319,914, 2,278,327 and 1,894,605.

DESCRIPTION OF THE INVENTION

The invention is described with reference to the appended drawings in which the prism is a regular triangular prism. The prism need not be regular but can be any right prism and it need not be traingular but its bases may be any type of polygon, perferably convex.

FIG. 1 of the drawings is an exploded view of the building block.

Figure 1:
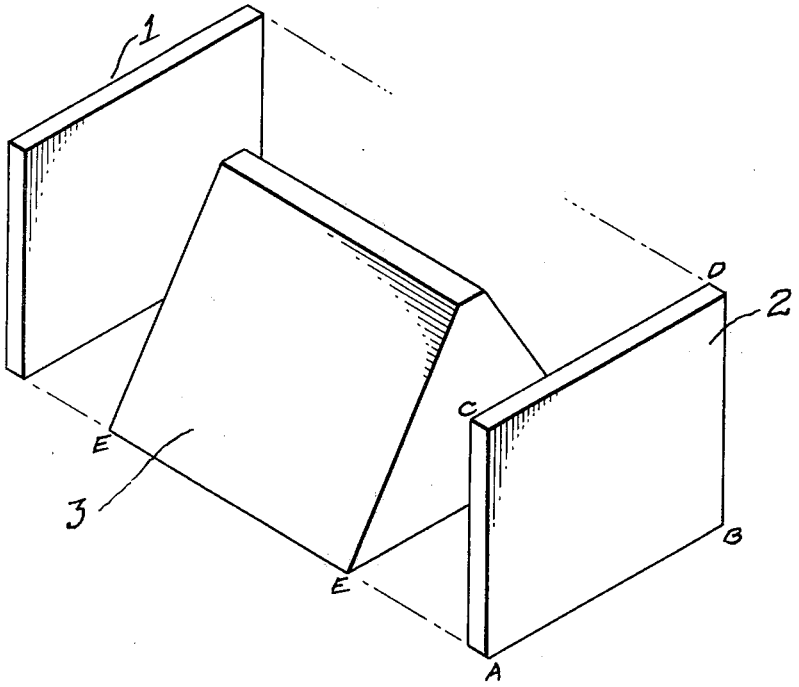

Referring now to FIG. 1 of the appended drawings, thin, flat, resilient, rectangular plates 1 and 2 are identical in size and shape. Regular triangular right prism 3 lies between rectangular plates 1 and 2.

Width AB of the rectangular plates is slightly greater than altitude EE of prism 3. Width AB is made slightly longer than altitude EE so that when two blocks are fitted together width AB of a second block will fit snugly between end plates 1 and 2 of the first block forcing them slightly farther apart and be firmly held between them as a result of the tendency of the resilient plates to return the positions held before being forced a bit further apart.

Figure 2:
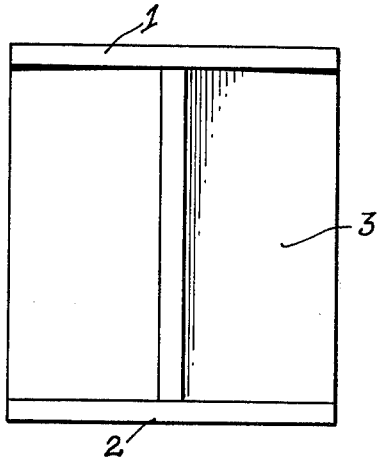
FIG. 2 is a plan view of the block.
Figure 4:
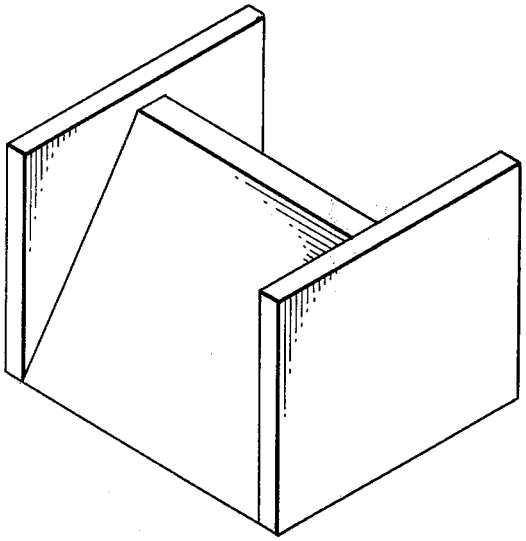
FIG. 4 is an isometric view of the building block.

FIG. 2 of the drawings is a plan view showing regular triangular prism 3 between end plates 1 and 2.

Figure 3:
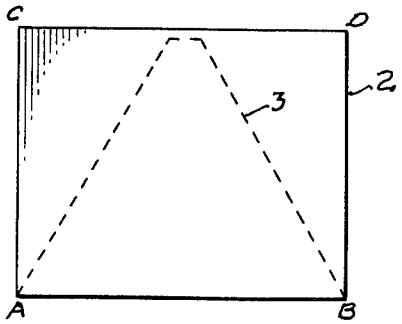
FIG. 3 is an end view of the block.

FIG. 3 of the appended drawings is an end view showing end plate 2 having a length BD slightly greater than the altitude of the prism on the prism face adjacent plate 2.

The blocks may be made using any right prism as the prism member. The prism bases may be triangular as illustrated in the drawings or square or pentagonal or hexagonal, etc. It is preferred that the prism be a regular prism since blocks of this kind and the various structures which may be formed using a plurality of the blocks have greater symmetry and generally a more pleasing appearance.

The prism members may be either solid or hollow.

The flat rectangular plates must have widths which are very slightly greater than the altitude of the prism. This plate width is required in order to permit the blocks to be fitted together in such a way that the flat end plate of the second block is snugly and firmly held between the two end plates of a first block. The length of the end plates should be greater than the largest altitude of the prism base so that the prism bases are overlapped by the rectangular plates leaving room for the insertion of a second block between the end plates of a first block along the greater part, at least, of the periphery of the base of the first block.

The prisms may be constructed from wood or metal or from plastic materials such as polyethylene, polypropylene, nylon, etc. Any plastic material which is a nontacky solid having a reasonably high melting point or softening point preferably above the boiling point of water may be used.

If the prism is to be hollow, then the faces of the prism are separately formed and may be beveled at their edges for convenience in assembling them and then the faces may be attached by cementing or glueing or by the use of small brads.

The end plates must be constructed from a material having a reasonable degree of elastic resilience so that when an end plate of a second block is inserted between the end plates of a first block forcing the end plates of the first block slightly farther apart, the resilience of the end plates of the first block causes exertion of a holding force against the inserted end plate of the second block.

When the prism member of the block is to be solid, then the entire block may be conveniently constructed from a suitable plastic by blow molding.

The size of the prisms is not critical and they may be conveniently built using prisms having an altitude in the range about 1 inch to about 6 inches. Larger blocks could be built but their greater weight makes it more difficult to put together multi-block structures since the holding force is just the pressure between the end plates of a first block and the end plate of a second block which is snugly fitted between them.

The resilient end plates must be thin, of the order of 1/10 to as much as $\frac{1}{4}$ inch in thickness depending on the material of construction. If the plates are made of stronger materials such as steel, a thickness about 1/16 inch is adequate while end plates made from wood should be about $\frac{1}{8}$ to $\frac{1}{4}$ inch in thickness. Plates made from plastics such as nylons, polycarbonates and the like may have thicknesses within the 1/16–$\frac{1}{4}$ inch range.

The altitude of the prism is desirably at least ten times the thickness of the end plates to provide a block shape better adapted to erecting complex structures by joining many blocks together.

The blocks are preferably colored, each face of the prism and the end plates may be made of different colors.

What is claimed is:

1. An educational building block comprising a right prism and two thin, flat, resilient, rectangular plates having widths slightly greater than the altitude of the prism and lengths greater than the greatest altitude of the prism bases, one of said plates being rigidly attached to each base of the prism so that the flat surface of the plates coincides with the prism base and the plates being so oriented that they are in mirror image relationship to each other.

2. A building block as defined in claim 1 wherein the prism is a regular prism.

3. A building block as defined in claim 1 wherein the prism is a regular prism and the flat plates are attached to the bases so that the width of each flat plate is parallel to one side of the base to which it is attached.

4. A building block as defined in claim 1 wherein the prism is a regular prism and the flat plates are attached to the bases so that the width of the flat plate coincides with one side of the prism base.

5. An educational building block comprising a regular, right triangualr prism and two thin, flat, resilient, rectangular plates, each of said plates having one pair of its parallel sides slightly greater in length than the altitude of the prism and the other pair of its parallel sides greater in length than the altitude of the prism bases, one of said plates being rigidly attached to each base of the prism so that its flat surface is in contact with a prism base, so that one of its sides which is slightly greater in length than the altitude of the prism lies on one edge of the prism base and so that the plates are in mirror image relationship with each other.

6. A building block as defined in claim 1 wherein the altitude of the prism is in the range 1 to 6 inches and the thin, flat, rectangular plates are from about 1/10 to ¼ inch in thickness.

7. A plurality of building blocks which may be fitted together to create a variety of structures, each block comprising a right prism and two thin, flat, resilient, rectangular plates having widths slightly greater than the altitude of the prism and lengths greater than the greatest altitude of the prism bases, one of said plates being rigidly attached to each base of the prism so that the flat surface of the plates coincides with the prism base and the plates being so oriented that they are in mirror image relationship to each other.

* * * * *